United States Patent [19]

Couennault et al.

[11] 4,350,928

[45] Sep. 21, 1982

[54] CROSSED FIELD RE-ENTRANT BEAM AMPLIFIER

[75] Inventors: Pierre Couennault; Lucien Teyssier, both of Paris, France

[73] Assignee: Thomson-CSF, Paris, France

[21] Appl. No.: 138,503

[22] Filed: Apr. 9, 1980

[30] Foreign Application Priority Data

Apr. 13, 1979 [FR] France ..... 79 09490

[51] Int. Cl.[3] ..... H01J 25/34

[52] U.S. Cl. ..... 315/39.3; 315/39.51

[58] Field of Search ..... 315/39.3, 39.51

[56] References Cited

U.S. PATENT DOCUMENTS

| | | | |
|---|---|---|---|
| 3,096,457 | 7/1963 | Smith, Jr. et al. | 315/39.3 X |
| 3,255,422 | 6/1966 | Feinstein et al. | 315/39.3 |
| 3,257,576 | 6/1966 | Crapuchettes | 315/39.3 X |
| 3,471,744 | 10/1969 | Pryor | 315/39.77 |
| 3,646,383 | 2/1972 | Dudley et al. | 315/39.3 |
| 4,053,850 | 10/1977 | Farney et al. | 315/39.77 |
| 4,194,142 | 3/1980 | Gerard | 315/39.51 |

*Primary Examiner*—Saxfield Chatmon, Jr.
*Attorney, Agent, or Firm*—Roland Plottel

[57] ABSTRACT

A material which absorbs microwaves and constituted by carbon-filled ceramic material is placed in the vacuum enclosure level with the supports of the cylindrical cathode.

6 Claims, 1 Drawing Figure

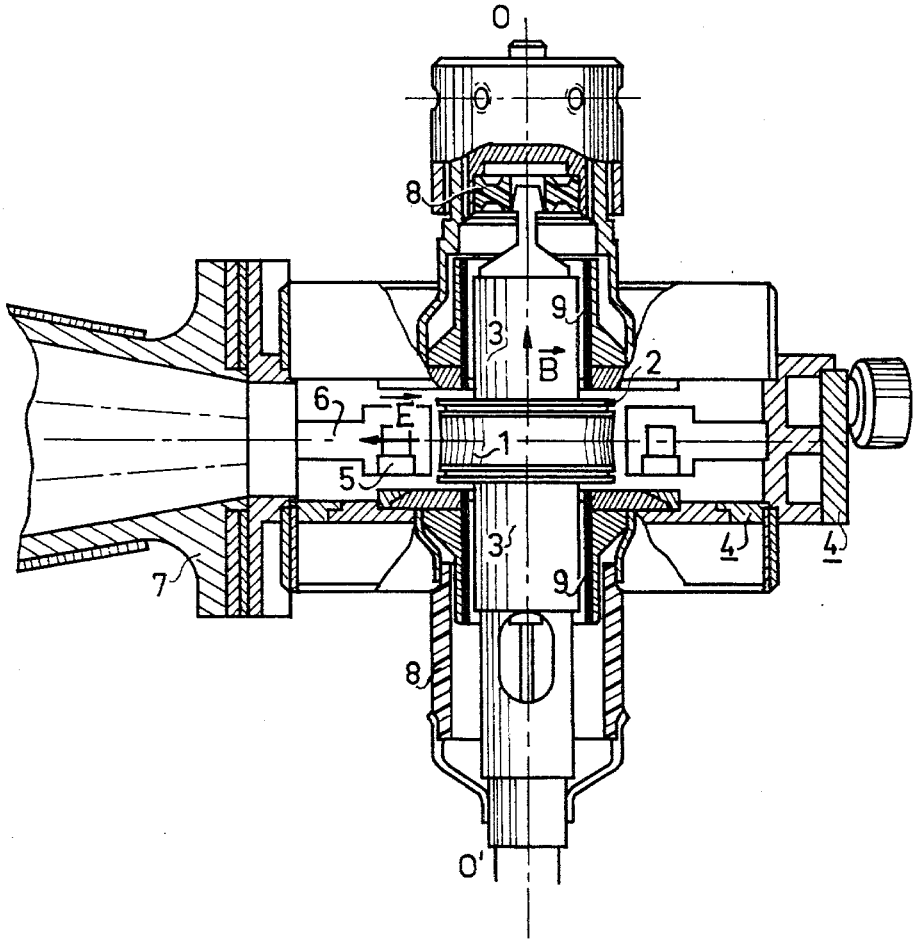
O
8
9
3
B
2
6
E
1
5
4
4
7
3
9
8
O'

CROSSED FIELD RE-ENTRANT BEAM AMPLIFIER

BACKGROUND OF THE INVENTION

The present invention relates to a crossed field, re-entrant beam amplifier. Such amplifiers generally have within a vacuum enclosure a substantially cylindrical cathode provided with two supports which ensure its fixing to the enclosure and a delay line with direct or backward wave propagation and which surrounds most of the cathode.

A first wave guide is connected to one of the ends of the delay line and supplies to it the microwaves to be amplified. A second wave guide connected to the other end of the delay line collects the amplified microwaves. The two ends of the delay line are separated by a so-called sliding zone.

An electrical field is established between the cathode and the delay line and a magnetic field is established in a direction perpendicular to the electrical field, in accordance with the axis of the cylinder constituting the cathode.

The operation of crossed field re-entrant beam amplifiers is explained by the interaction between the electron cloud from the cathode and the direct or backward microwaves propagated along the delay line. For certain values of the electric and magnetic fields, this electron beam forms a space charge arm which rotates around the cathode at a speed close to that of the microwaves. In this arm a first and larger part of the electrons passes from the cathode to the delay line to which the electrons transfer their potential energy and thus ensure the amplification of the signal. A second part of the electrons returns to the cathode and thus ensures its heating by bombardment. Finally, a third part of the electron is not collected and constantly rotates about the cathode, which gives rise to the term re-entrant beam tubes.

Crossed field, re-entrant beam amplifiers have the advantage of being compact and light weight, of having a high efficiency and of requiring only a single high voltage which has not been regulated with a high degree of precision, as is the case with the high voltages supplying travelling wave tubes. This high voltage establishes the electrical field between the cathode and the delay line. The energy due to the bombardment of the returning electrons is generally sufficient to heat the cathode.

The problem which arises is that the operating frequency band of crossed field re-entrant beam amplifiers is too narrow, being only approximately 10% about the central frequency.

BRIEF SUMMARY OF THE INVENTION

The present invention relates to a crossed field, re-entrant beam amplifier comprising means ensuring the reduction of the resonance ratio of the cavity resonator constituted by the vacuum enclosure, the cathode and its supports and the delay line.

According to a preferred embodiment of the invention, the means ensuring the reduction of the resonance ratio of the cavity resonator are constituted by a material which absorbs the microwaves and which is applied to the walls of the cavity resonator level with at least one of the two supports of the cathode.

The invention makes it possible to increase the operating frequency band of crossed field, re-entrant beam amplifiers.

One of the factors limiting the operating band of crossed field, re-entrant beam amplifiers is the lack of stability at certain discrete frequencies of the current circulating in the supply circuit of the cathode and the delay line.

The Applicant has found during measurements on a crossed field amplifier in the band S that the current instability is accompanied either by a reduction of power because there is a propagation of microwaves along the high voltage connections or a deterioration in the signal-to-noise ratio because there is an oscillations blank. It is therefore readily comprehensible that the operating band of the amplifier is limited to prevent the discrete frequencies for which the current instability occurs. The Applicant has also found that the discrete frequencies for which the current instability occurs are displaced on modifying the internal geometry of the amplifier. For example, this occurs on moving the covers sealing the vacuum enclosure.

The Applicant then carried out cold measurements, i.e. without a supply voltage on the same crossed field amplifier in the S band. During these measurements, propagation along the delay line was attenuated by using thin attenuating paper (50 to 60 decibels) in order not to disturb the geometry of the cathode-line space. The microwave input-output decoupling of the amplifier in the delay line propagation band (2.4 to 4 GHz) was then measured. There were found to be considerable variations in said decoupling about a means value and in particular there is a very considerable increase in attenuation at the frequencies for which power is evacuated by high voltage connections and there is a very large decrease in the attenuation at frequencies for which there is an oscillations blank.

Bearing in mind the phenomena observed on the amplifier, both under hot and cold conditions, the Applicant concluded that the vacuum enclosure, the cathode and its supports and the delay line constituted a parasitic cavity resonator coupled to the principle propagation mode of the delay line. As a function of the frequency, when this parasitic cavity resonator has a high impedance, it absorbs the energy which is then irradiated by the high voltage connections, whereas when said parasitic cavity resonator has a low impedance it tends to oscillate the amplifier.

To operate these phenomena and increase the operating frequency band, the amplifier according to the invention has means ensuring a reduction in the resonance ratio of the parasitic cavity resonator.

DESCRIPTION OF THE DRAWING AND PREFERRED EMBODIMENTS

The invention is described in greater detail hereinafter relative to non-limitative embodiments and the attached drawing showing a longitudinal section of a crossed field, re-entrant beam amplifier according to the invention.

The drawing is a longitudinal section along the axis 00' of the cylinder 1 which constitutes the cathode of an embodiment of a crossed field, reentrant beam amplifier according to the invention.

The cathode of the said amplifier is constituted by a molybdenum cylinder 1 covered with emissive tungsten and provided with hats which limit electron emission in space. A filament is wound onto an alumina support within the cylinder. This filament can receive a supply voltage permitting the starting of electron emission.

The cathode is provided with two supports 3, which ensure its fixing to the vacuum enclosure 4, which contains the complete amplifier.

A delay line 5 partly surrounds the cathode. This delay line is in the present embodiment in helical form with "a foot in the ground", i.e. each turn of the helix is connected to the vacuum enclosure which constitutes the ground by a tongue 6 of length $\lambda/4$.

A wave guide is connected to each end of delay line 5. The drawing shows one wave guide 7 in the form of a horn. One of the two wave guides connected to the delay line supplies the latter with the microwaves to be amplified, whilst the other wave guide connects the amplified microwaves. The two ends of the delay line are separated by the sliding zone.

An electric field $\vec{E}$ is established by high voltage sources between the cathode and the anode. A magnetic field $\vec{B}$ is established in accordance with the axis of the cylinder constituting the cathode.

The supports 3 of the cathode are insulated from the vacuum enclosure forming the ground by alumina elements 8.

The invention comprises providing in the amplifier means ensuring the reduction in the resonance ratio of the parasitic cavity resonator constituted by the vacuum enclosure, the cathode and its supports and the delay line.

According to a preferred embodiment of the invention, the means ensuring the reduction of the resonance ratio of the cavity resonator are constituted by a material 9 which absorbs the microwaves and which is disposed in the vacuum enclosure level with at least one of the two supports of the cathode. It is important to place the insulating material level with the cathode supports 3, because in this way it does not absorb the fundamental mode to be amplified, as would be the case on arranging it level with the cathode.

The absorbing material 9 can be placed on the walls of the vacuum enclosure facing supports 3 of the cathode, as shown in the drawing. The absorbing material can also be directly placed on the cathode supports 3.

The absorbing material 9 used must be in accordance with the general standards for materials used in the construction of electron tubes. It must have a low vapour tension and, in view of the immediate vicinity to the cathode, it must have a good thermal behaviour and a good thermal conductivity.

The absorbing material 9 is preferably an insulant having a low dielectric constant. It must also be machinable to precise dimensions. Thus, the requirements concerning the voltage and thermal behaviour of the cathode limit the possible thickness of the absorbing material in order to prevent a high voltage breakdown.

Carbon-filled ceramics are used for making cylinders of absorbing materials 9. Very good results have been obtained with an absorbing material 9 constituted by 99% silicon carbide Si C and 1% metallic impurities.

The following have also been used with good results:

40% silicon carbide Si C and 60% magnesium oxide Mg O or beryllium oxide Be O;

80% silicon carbide Si C and 20% beryllium oxide Be O;

porous alumina and methane decomposed at approximately 1000° to 1200° C.

What is claimed is:

1. A crossed field, re-entrant beam amplifier comprising in a vacuum enclosure a substantially cylindrical cathode, provided with two supports, and a delay line which surrounds most of the cathode, a parasitic cavity resonator constituted by the vacuum enclosure, the cathode and its supports and the delay line means ensuring the reduction of the resonance ratio of the cavity resonator, said means being constituted by a material which absorbs microwaves which is applied to the walls of the cavity resonator level with at least one of the two supports of the cathode.

2. An amplifier according to claim 1, wherein the material absorbing the microwaves is carbon-filled ceramic material.

3. An amplifier according to claim 2, wherein the material absorbing the microwaves is constituted by 99% silicon carbide Si C and 1% metallic impurities.

4. An amplifier according to claim 2, wherein the material absorbing the microwaves is constituted by 40% silicon carbide Si C and 60% magnesium oxide Mg O or beryllium oxide Be O.

5. An amplifier according to claim 2, wherein the material absorbing the microwaves is constituted by 80% silicon carbide Si C and 20% beryllium oxide Be O.

6. An amplifier according to claim 2, wherein the material absorbing the microwaves is constituted by porous alumina and methane decomposed at approximately 1000° to 1200° C.

* * * * *